US008907869B2

(12) United States Patent
Chun

(10) Patent No.: US 8,907,869 B2
(45) Date of Patent: Dec. 9, 2014

(54) ORGANIC LIGHT EMITTING DISPLAY

(75) Inventor: Hae-Jin Chun, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1414 days.

(21) Appl. No.: 12/410,342

(22) Filed: Mar. 24, 2009

(65) Prior Publication Data

US 2009/0289876 A1 Nov. 26, 2009

(30) Foreign Application Priority Data

May 26, 2008 (KR) ..... 10-2008-0048559

(51) Int. Cl.
*G09G 3/30* (2006.01)
*G09G 3/32* (2006.01)

(52) U.S. Cl.
CPC ..... *G09G 3/3233* (2013.01); *G09G 3/325* (2013.01); *G09G 2300/0861* (2013.01); *G09G 2310/0262* (2013.01); *G09G 2320/043* (2013.01)
USPC ..... 345/76

(58) Field of Classification Search
CPC ..... G09G 3/30; G09G 2300/0842; G09G 2320/043
USPC ..... 345/76–83; 315/169.3; 313/463, 504
See application file for complete search history.

(56) References Cited

U.S. PATENT DOCUMENTS

2006/0071884 A1* 4/2006 Kim ..... 345/76
2008/0036371 A1* 2/2008 Kim ..... 313/504

FOREIGN PATENT DOCUMENTS

| | | |
|---|---|---|
| JP | 2006-301159 | 11/2006 |
| KR | 10-2005-0052033 | 6/2005 |
| KR | 10-2006-0013119 A | 2/2006 |
| KR | 10-2006-0018763 A | 3/2006 |
| KR | 10-2006-0018766 A | 3/2006 |

OTHER PUBLICATIONS

English Machine Translation for KR 10-2005-0052033, Jul. 16, 2012, pp. 1-19.*
English Machine Translation for KR 10-2006-0013119, Jul. 16, 2012, pp. 1-24.*
KIPO Office action dated Oct. 30, 2009 for priority Korean patent Application No. 10-2008-0048559, as well as KR 10-2005-0052033 previously filed in an IDS dated .Mar. 24, 2009.

* cited by examiner

*Primary Examiner* — Jimmy H Nguyen
(74) *Attorney, Agent, or Firm* — Christie, Parker & Hale, LLP

(57) ABSTRACT

An organic light emitting display is provided. In each circuit of pixels constituting a pixel unit, a transistor for providing an initialization voltage is arranged so that leakage current is reduced when the transistor is turned off. When the transistor is implemented as a dual gate transistor with a similar transistor from an adjacent pixel, layout space may be conserved.

10 Claims, 3 Drawing Sheets

ORGANIC LIGHT EMITTING DISPLAY

CROSS-REFERENCE TO RELATED APPLICATIONS

This application claims priority to and the benefit of Korean Patent Application No. 10-2008-0048559, filed on May 26, 2008, in the Korean Intellectual Property Office, the entire content of which is incorporated herein by reference.

BACKGROUND

1. Field of the Invention

The present invention relates to an organic light emitting display.

2. Discussion of Related Art

Recently, there have been various types of flat panel display devices having reduced weight and volume in comparison to cathode ray tubes. Flat panel display devices include liquid crystal displays (LCDs), field emission displays (FEDs), plasma display devices, and organic light emitting displays, among others.

An organic light emitting display device displays images using organic light emitting diodes (OLEDs) that emit light through the recombination of electrons and holes. An organic light emitting display device has a fast response speed and is driven with low power consumption.

Generally, organic light emitting displays are divided into passive matrix OLED (PMOLED) devices and active matrix OLED (AMOLED) devices, depending on the method of driving electroluminescence (EL) elements in the displays.

An AMOLED device includes a plurality of gate lines, a plurality of data lines, a plurality of power lines and a plurality of pixels connected to the lines and arranged in a matrix form. Each of the pixels generally includes an EL element (i.e., an OLED); a switching transistor for providing a data signal; a driving transistor for driving the EL element in accordance with the data signal; and a capacitor for storing the voltage of the data signal.

An AMOLED device generally has low power consumption. However, in an AMOLED, the intensity of current that flows through the EL elements varies depending on voltage variations between gate and source electrodes of driving transistors for driving the EL elements, i.e., variations in threshold voltages of the driving transistors. Therefore, display uniformity may be compromised.

That is, characteristics of transistors provided in each of the pixels vary depending on manufacturing processes. Therefore, it is difficult to manufacture uniform transistors so that all the transistors of an AMOLED device have the same characteristics. Thus, variations in threshold voltages between pixels exist.

In order to solve these problems, compensation circuits have been recently developed. Such compensation circuits may be implemented in each pixel. However, as larger numbers of transistors and capacitors are fabricated into each pixel, it becomes more difficult to secure space in layout designs.

SUMMARY OF THE INVENTION

Accordingly, it is an aspect of an exemplary embodiment of the present invention to provide an organic light emitting display where, in each circuit of pixels constituting a pixel unit, a transistor provides an initialization voltage Vinit, where the transistor is implemented as a dual gate transistor.

It is another aspect of an exemplary embodiment of the present invention to provide an organic light emitting display where, the transistor is implemented as a dual gate transistor by being connected to a similar transistor provided in an adjacent pixel.

According to one aspect, an embodiment of the present invention provides an organic light emitting display, including: a plurality of gate lines, a plurality of data lines, a plurality of power lines, a plurality of light emission control lines; and a plurality of pixels arranged at regions defined by the plurality of gate lines, the plurality of data lines the plurality of power lines, and the plurality of light emission control lines, wherein each of the plurality of pixels includes: a first switching transistor for providing a data signal in response to a current scan signal; a driving transistor for generating a driving current corresponding to the data signal; a capacitor for storing the data signal; an electroluminescence element for emitting light in accordance with the driving current; and a discharge transistor for discharging the data signal from the capacitor in response to a previous scan signal; wherein the discharge transistors of at least two adjacent pixels share a same drain and are coupled to a single transistor.

According to another aspect, an exemplary embodiment of the present invention provides an organic light emitting display, including: a voltage source having an initialization voltage; a plurality of pixels, wherein each of the plurality of pixels includes a first transistor coupled to the voltage source; and a second transistor coupled between the first transistor of at least two adjacent pixels of the plurality of pixels and the voltage source, wherein gate electrodes of the first transistors of the at least two adjacent pixels and the second transistor are coupled together, drain electrodes of the first transistors of the at least two adjacent pixels are coupled to a source electrode of the second transistor, and a drain electrode of the second transistor is coupled to the voltage source, so that the first transistors and the second transistor are configured to supply the initialization voltage to the at least two adjacent pixels.

According to yet another aspect, an exemplary embodiment of the present invention provides a pixel circuit coupled to a gate line, a data line, a power line, and a light emission control line, with the pixel circuit including: a first switching transistor for switching a data signal provided by the data line in response to a current scan signal provided by the gate line; a capacitor for storing the data signal; a driving transistor for generating a current corresponding to the data signal; a compensation transistor for compensating for a threshold voltage of the driving transistor; a second switching transistor for connecting the power line to the driving transistor in accordance with a current light emission control signal provided by the light emission control line; an electroluminescence element for emitting light in accordance with the current; a third switching transistor for providing the current to the electroluminescence element in response to the current light emission control signal; and a discharge transistor for discharging the data signal from the capacitor, wherein the discharge transistor and the discharge transistor of an adjacent pixel circuit comprise a dual gate transistor.

BRIEF DESCRIPTION OF THE DRAWINGS

The accompanying drawings, together with the specification, illustrate certain exemplary embodiments of the present invention, and, together with the description, serve to explain the principles of the present invention.

DETAILED DESCRIPTION OF EXEMPLARY EMBODIMENTS

Figure 1:
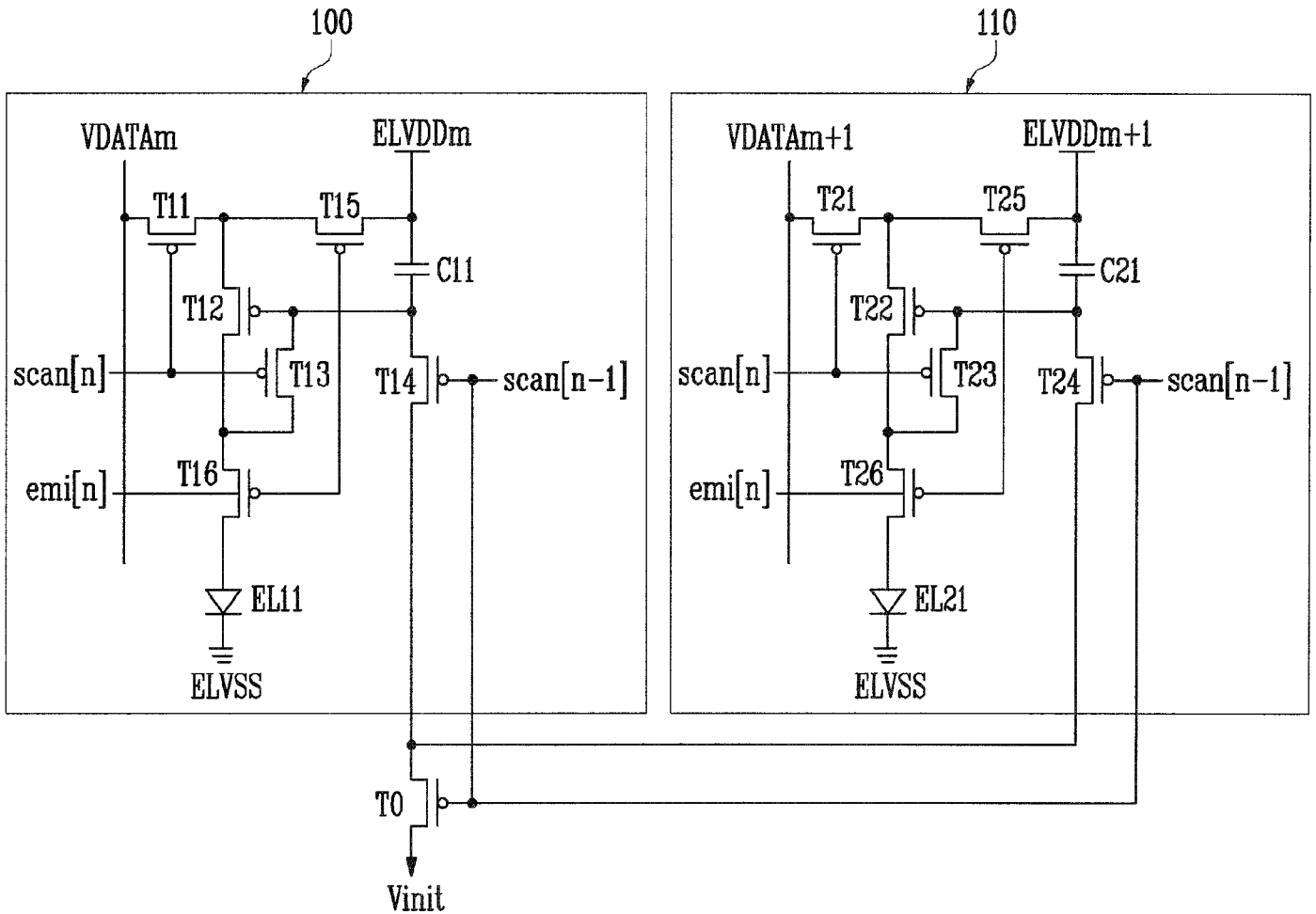
FIG. 1 is a circuit diagram showing the structure of a pixel circuit in an organic light emitting display according to a first embodiment of the present invention.

Hereinafter, certain exemplary embodiments according to the present invention will be described with reference to the accompanying drawings. When a first element is described as being coupled to a second element, the first element may be directly coupled to the second element, or may alternatively be indirectly coupled to the second element via additional elements. Further, some elements that are not essential to a complete understanding of the invention are omitted for clarity. In addition, like reference numerals refer to like elements throughout.

Figure 2:
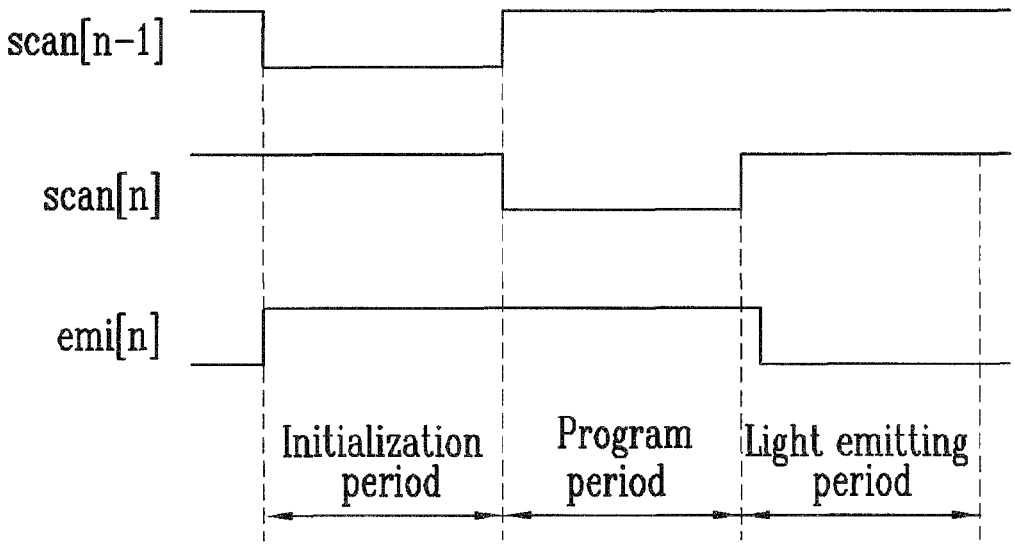
FIG. 2 is a driving timing diagram of the pixel circuit shown in FIG. 1.

FIG. 1 is a circuit diagram showing the structure of a pixel circuit in an organic light emitting display according to a first embodiment of the present invention. FIG. 2 is an example of a driving timing diagram of the pixel circuit shown in FIG. 1.

The organic light emitting display according to the first embodiment of the present invention includes a plurality of gate lines, a plurality of data lines, a plurality of power lines, a plurality of light emission control lines, and a plurality of pixels respectively arranged at regions defined by the plurality of gate, data, power and light emission control lines.

FIG. 1 shows circuits for a pair of adjacent pixels 100 and 110 respectively arranged at regions defined by corresponding gate, data, power and light emission control lines (e.g., an n-th gate line, m-th and (m+1)-th data lines, m-th and (m+1)-th power lines and an n-th light emission control line).

Referring to FIG. 1, the pixels 100 and 110 of the organic light emitting display according to the first embodiment of the present invention include organic electroluminescence elements EL11 and EL21 for emitting light in accordance with an applied driving current; first switching transistors T11 and T21 for switching data signals VDATAm and VDATAm+1 applied to corresponding data lines in accordance with a current scan signal scan[n] applied to a corresponding gate line; and driving transistors T12 and T22, which supply the driving current to the EL elements in response to data signals inputted to the gate electrodes of the driving transistors T12 and T22, respectively.

The first switching transistors T11 and T12 are p-type thin film transistors. The current scan signal scan[n] is applied to the gate electrodes of the first switching transistors T11 and T21, and the data signals VDATAm and VDATAm+1 are applied to source electrodes of the first switching transistors T11 and T21, respectively. Drain electrodes of the first switching transistors T11 and 21 are coupled to source electrodes of the driving transistors T12 and T22, respectively.

The driving transistors T12 and T22 are also p-type thin film transistors. Gate electrodes of the driving transistors T12 and T22 are coupled to one terminal of capacitors C11 and C21, respectively. The source electrodes of the driving transistors T12 and T22 are coupled to the drain electrodes of the first switching transistors T11 and T21, respectively. Drain electrodes of the driving transistors T12 and T22 are coupled to anode electrodes of the EL elements EL11 and EL21, respectively. As shown in FIG. 1, cathode electrodes of the EL elements EL11 and EL21 are coupled to a second power voltage source ELVSS.

The pixels 100 and 110 further include transistors T13 and T23, which compensate the threshold voltages of the driving transistors T12 and T22, respectively; the capacitors C11 and C21, which store data signals to be applied to the gate electrodes of the driving transistors T12 and T22, respectively; and transistors T14 and T24, which initialize each of capacitors C11 and C21 by discharging data signals stored in the capacitors, and replacing the data signals with an initialization voltage, in response to a previous scan signal scan[n-1] applied to a previous gate line.

In one embodiment, the transistors T13 and T23 are p-type thin film transistors and are used for threshold voltage compensation. The transistors T13 and T23 are coupled between gate and drain electrodes of the respective driving transistors T12 and T22. The current scan signal scan[n] is applied to gate electrodes of the transistors T13 and T23.

As described above, one terminal of capacitors C11 and C21 is coupled to the gate electrodes of respective driving transistors T12 and T22. The other terminal of each of capacitors C11 and C21 is respectively coupled to first power voltage sources ELVDDm and ELVDDm+1 so that a first power voltage ELVDD provided from each of the first power voltage sources ELVDDm and ELVDDm+1 is applied to the other terminals of respective capacitors C11 and C21.

The transistors T14 and T24 are used for initialization and are also p-type thin film transistors. A previous scan signal scan[n-1] is applied to the gate electrodes of the transistors T14 and T24, and source electrodes of the transistors T14 and T24 are coupled to one terminal of respective capacitors C11 and C21. An initialization voltage Vinit is applied to drain electrodes of the transistors T14 and T24.

In the first embodiment of the present invention, the transistors T14 and T24 are implemented together as a dual gate transistor. In the first embodiment of the present invention, when the transistor T14 is implemented as a dual gate transistor, it is coupled to the transistor T24 provided in the adjacent pixel 110, as illustrated in FIG. 1.

There is further provided a single transistor T0 having a gate electrode coupled to the gate electrodes of the transistors T14 and T24, a source electrode coupled to the drain electrodes of the transistors T14 and T24, and a drain electrode coupled to the initialization voltage source Vinit. As discussed above, the transistors T14 and T24 are implemented as a dual gate transistor.

Consequently, in the first embodiment of the present invention, the transistors T14 and T24 which provide initialization voltage Vinit, are arranged so that leakage current is reduced when the transistors T14 and T24 are turned off. Concurrently, when the transistor T14 is implemented as a dual gate transistor with transistor T24, layout space may be conserved.

In FIG. 1, each pixel circuit includes at least six transistors, some of which will be discussed in further detail below, and at least one capacitor. As such, it may be difficult to secure space for all the components in a layout design.

Furthermore, when additional transistors are implemented to reduce leakage current, the problem may be compounded. However, as described in the first embodiment of the present invention, the transistors T14 and T24 may be implemented as a dual gate transistor, coupling them together to the single transistor T0, which further conserves space. Accordingly, the problem may be alleviated.

Pixels 100 and 110 may further include second switching transistors T15 and T25 for providing the first power voltage ELVDD to the driving transistors T12 and T22 in response to a current light emission control signal emi[n], and third switching transistors T16 and T26 for providing the driving current generated from the driving transistors T12 and T22 to the EL elements EL11 and EL21 in response to the current light emission control signal emi[n], respectively.

The second switching transistors T15 and T25 are p-type thin film transistors. The current light emission control signal emi[n] is applied to the gate electrodes of the second switching transistors T15 and T25, the first power voltage ELVDD is applied to source electrodes of the second switching transistors T15 and T25. Drain electrodes of the second switching transistors T15 and T25 are coupled to the source electrodes of the driving transistors T12 and T22, respectively.

The third switching transistors T16 and T26 are also p-type thin film transistors. The current light emission control signal emi[n] is also applied to the gate electrodes of the third switching transistors T16 and T26. The third switching transistors T16 and T26 are further coupled between the driving transistors T12 and T22 and the anode electrodes of the EL elements EL11 and EL21, respectively.

Although not shown in FIG. 1, second capacitors may further be coupled between the gate electrodes of the first switching transistors T11 and T21 and the driving transistors T12 and T22, respectively. The second capacitors may enable the driving transistors T12 and T22 and the capacitors C11 and C21 to implement more exact switching operations through, for example, bootstrapping operations of the second capacitors.

In the pixel circuits according to the first embodiment of the present invention, the transistors T14 and T24 are arranged so that a low off-current characteristic is maintained, i.e., that the data signals of the capacitors C11 and C21 are maintained by preventing leakage current from being generated at the initialization voltage source Vinit. Further, the transistor T14 may be implemented as a dual gate transistor with the transistor T24 to conserve space.

An operation of the pixel circuit of the present invention having a configuration described above will now be described with reference to FIGS. 1 and 2.

In an initialization operation, i.e., in an initialization period in which the previous scan signal scan[n-1] is set low, and the current scan signal scan[n] and the current light emission control signal emi[n] are set high, the transistors T14 and 24 are turned on by the previous scan signal scan[n-1], while the other transistors are turned off by the current scan signal scan[n] and the current light emission control signal emi[n]. Therefore, data stored in the capacitors C11 and 21 during the initialization period, i.e., the gate voltages of the driving transistors T12 and T22, are initialized as the initialization voltage Vinit.

As described above, the transistors T14 and T24 are coupled to a separate single transistor T0.

That is, the gate electrode of the single transistor T0 is coupled to the gate electrodes of the transistors T14 and T24 and a source electrode of the single transistor T0 is coupled to the drain electrodes of the transistors T14 and T24. A drain electrode of the single transistor T0 is coupled to the initialization voltage source Vinit. Accordingly, the transistors T14 and T24 are implemented as a dual gate transistor.

As such, when the transistor T14 is implemented as a dual gate transistor, it may be coupled to the transistor T24 in, for example, the manner prescribed above, to conserve layout space.

Next, in a data program operation, the transistors T14 and T24 are turned off, and the transistors T13 and T23 are turned on by a low current scan signal scan[n], during which time the previous scan signal scan[n-1] and the current light emission control signal emi[n] are set high, as shown in FIG. 2. Therefore, the driving transistors T12 and T22 are consequently coupled in a diode form.

The first switching transistors T11 and T12 are turned on, and the second and third switching transistors T15, T16, T25, and T26 are turned off, forming a data program path. Therefore, the data voltages VDATAm and VDATAm+1 are provided to the gate electrodes of the driving transistors T12 and T22 through the transistors T13 and T23, respectively.

At this time, since the transistors T13 and T23 are turned on, the driving transistors T12 and T22 are coupled in a diode form, whereby problems caused by fluctuation of the threshold voltage in the driving transistors T12 and T22 may be automatically compensated.

Finally, in a light emitting operation, the second and third switching transistors T15, T16, T25, and T26 are turned on, while the first switching transistors T11 and T21, along with transistors T14, T24, T13, and T23 are turned off. During the light emitting period, the previous scan signal scan[n-1] and the current scan signal scan[n] are set high, while the current light emission control signal emi[n] is set low, as shown in FIG. 2.

Therefore, driving currents generated corresponding to the data signals of voltage levels applied to the gate electrodes of the driving transistors T12 and T22 are provided to the organic EL elements EL11 and EL21 through the driving transistors T12 and T22, respectively, so that the organic EL elements EL11 and EL21 emit light.

As described above, in the first embodiment of the present invention, variations between the threshold voltages of the driving transistors T12 and T22 are detected through the transistors T13 and T23 and automatically compensated. Thus, current that flows into the organic EL elements EL11 and EL21 can be more precisely controlled.

In addition, the transistors T14 and T24 are implemented as a dual gate transistor, so that leakage current may be prevented by reducing off-current in a period in which the transistors T14 and T24 are turned off, i.e., in the program period and the light emitting period described above, while conserving space. Accordingly, data signals stored in the capacitors C11 and C21 can be more stably maintained.

Figure 3:
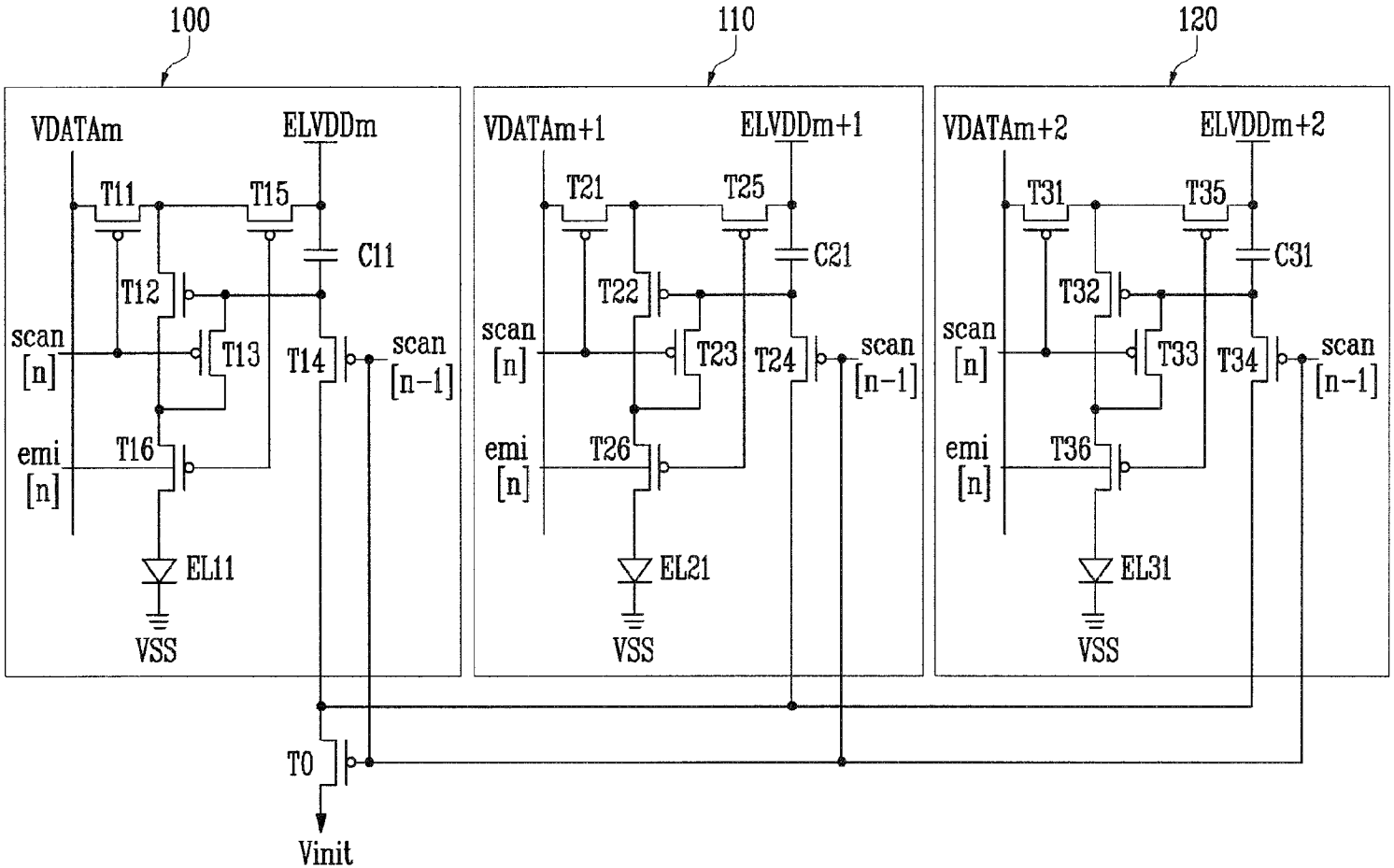
FIG. 3 is a circuit diagram showing the structure of a pixel circuit in an organic light emitting display according to a second embodiment of the present invention.

FIG. 3 is a circuit diagram showing the structure of a pixel circuit in an organic light emitting display according to a second embodiment of the present invention.

In FIG. 3, according to the second embodiment of the present invention, each pixel circuit includes the same components as those of the pixel circuits shown in FIG. 1 according to the first embodiment of the present invention, where like components are generally designated by the same reference numerals, and their operations are substantially the same. Therefore, a detailed description of individual pixel operation will be omitted.

In the first embodiment shown in FIG. 1, the transistors T14 and T24 are coupled to the single transistor T0, and are implemented as a dual gate transistor. Similarly, in the second embodiment shown in FIG. 3, three pixels 100, 110 and 120 respectively emit red (R), green (G) and blue (B) to constitute one single pixel group, and transistors T14, T24 and T34, respectively provided in the three pixels, are coupled to one single transistor T0.

That is, in the second embodiment of the present invention, the transistors T14, T24 and T34 are implemented as shown in FIG. 3. Specifically, space may be optimized in a layout design when the transistors T14, T24 and T34 are coupled to a single transistor T0.

Therefore, there is provided a single transistor T0 having a gate electrode coupled to gate electrodes of the transistors T14, T24 and T34, a source electrode coupled to drain electrodes of the transistors T14, T24 and T34, and a drain electrode coupled to an initialization voltage source Vinit.

While the present invention has been described with respect to particular embodiments, it is to be understood that the invention is not limited to the disclosed embodiments, but instead is intended to cover various modifications and equivalent arrangements included within the spirit and scope of the appended claims and equivalents thereof.

What is claimed is:

1. An organic light emitting display, comprising:

a plurality of gate lines, a plurality of data lines, a plurality of power lines and a plurality of light emission control lines; and a plurality of pixels at regions defined by the plurality of gate lines, the plurality of data lines, the plurality of power lines, and the plurality of light emission control lines, wherein each of the plurality of pixels comprises:

a first switching transistor for providing a data signal in response to a current scan signal;

a driving transistor for generating a driving current corresponding to the data signal;

a capacitor for storing the data signal;

an electroluminescence element for emitting light in accordance with the driving current; and a discharge transistor for discharging the data signal from the capacitor in response to a previous scan signal, wherein drain electrodes of the discharge transistors of at least two adjacent pixels of the plurality of pixels are directly connected to each other and are coupled to a single transistor, and wherein the single transistor has a gate electrode directly connected to gate electrodes of the discharge transistors of the at least two adjacent pixels, a source electrode directly connected to the drain electrodes of the discharge transistors of the at least two adjacent pixels, and a drain electrode coupled to a voltage source having an initialization voltage.

2. The organic light emitting display of claim 1, wherein the at least two adjacent pixels comprise two pixels, and wherein gate electrodes of the discharge transistors of the two pixels are directly connected to each other.

3. The organic light emitting display of claim 1, wherein the at least two adjacent pixels comprises three pixels constituting a pixel group, including a red emitting pixel, a green emitting pixel, and a blue emitting pixel.

4. The organic light emitting display of claim 1, wherein each of the pixels further comprises:

a compensation transistor for compensating for a threshold voltage of the driving transistor;

a second switching transistor for providing a first power voltage source to the driving transistor in accordance with a current light emission control signal; and a third switching transistor for providing the driving current to the electroluminescence element in response to the current light emission control signal.

5. The organic light emitting display of claim 1, wherein each of the transistors is a p-type transistor.

6. An organic light emitting display comprising:

a voltage source having an initialization voltage;

a plurality of pixels, each of the plurality of pixels including a first transistor coupled to the voltage source; and a second transistor coupled between both the first transistors of at least two adjacent pixels of the plurality of pixels and the voltage source;

wherein gate electrodes of the first transistors of the at least two adjacent pixels and the second transistor are directly connected to each other, wherein drain electrodes of the first transistors of the at least two adjacent pixels are directly connected to each other, and are directly connected to a source electrode of the second transistor, and a drain electrode of the second transistor is coupled to the voltage source, so that the first transistors and the second transistor are configured to supply the initialization voltage to the at least two adjacent pixels.

7. The organic light emitting display of claim 6, wherein the at least two adjacent pixels comprise two pixels, and wherein gate electrodes of the first transistors of the two pixels are directly connected to each other.

8. The organic light emitting display of claim 6, wherein the at least two adjacent pixels comprise a pixel group having three pixels, including a red emitting pixel, a green emitting pixel, and a blue emitting pixel.

9. The organic light emitting display of claim 6, wherein each of the plurality of pixels further comprises:

a capacitor for storing the initialization voltage supplied by the first transistor and the second transistor;

a switching transistor for replacing the initialization voltage stored in the capacitor with a data signal;

a driving transistor for generating a driving current corresponding to the data signal; and an electroluminescence element for emitting light by utilizing the driving current;

wherein the first transistor and the second transistor are configured to replace the data signal stored in the capacitor with the initialization voltage.

10. A pixel circuit coupled to a gate line, a data line, a power line, and a light emission control line, the pixel circuit comprising:

a first switching transistor for switching a data signal provided by the data line in response to a current scan signal provided by the gate line;

a capacitor for storing the data signal;

a driving transistor for generating a current corresponding to the data signal;

a compensation transistor for compensating for a threshold voltage of the driving transistor;

a second switching transistor for connecting the power line to the driving transistor in accordance with a current light emission control signal provided by the light emission control line;

an electroluminescence element for emitting light in accordance with the current;

a third switching transistor for providing the current to the electroluminescence element in response to the current light emission control signal; and a discharge transistor for discharging the data signal from the capacitor;

wherein a gate electrode of the discharge transistor and a gate electrode of an adjacent discharge transistor of an adjacent pixel circuit are directly connected to each other, and wherein drain electrodes of the discharge transistor and the adjacent discharge transistor are both directly connected to a same electrode of another transistor supplying an initialization voltage, and wherein the gate electrode of the discharge transistor and the gate electrode of the adjacent discharge transistor are directly connected to a gate electrode of the another transistor.

* * * * *